US007066203B2

(12) United States Patent
Baarda

(10) Patent No.: US 7,066,203 B2
(45) Date of Patent: Jun. 27, 2006

(54) GAS FLOW CONTROL

(75) Inventor: Gerrit Jan Baarda, Emmen (NL)

(73) Assignee: Honeywell International, Inc., Morristown, NJ (US)

( * ) Notice: Subject to any disclaimer, the term of this patent is extended or adjusted under 35 U.S.C. 154(b) by 285 days.

(21) Appl. No.: 10/622,097

(22) Filed: Jul. 17, 2003

(65) Prior Publication Data

US 2004/0055651 A1 Mar. 25, 2004

(30) Foreign Application Priority Data

Jul. 18, 2002 (DE) ..... 102 32 647

(51) Int. Cl.
*F16K 31/124* (2006.01)

(52) U.S. Cl. ..... 137/613; 137/488; 137/489; 137/495; 137/510

(58) Field of Classification Search ..... 137/613, 137/488, 489, 510, 495
See application file for complete search history.

(56) References Cited

U.S. PATENT DOCUMENTS 3,741,710 A 6/1973 Nelson
6,418,956 B1 * 7/2002 Bloom ..... 137/488
6,923,204 B1 * 8/2005 Dalton et al. ..... 137/489

FOREIGN PATENT DOCUMENTS

| | | |
|---|---|---|
| DE | 21 11 343 | 4/1972 |
| DE | 198 21 853 C1 | 7/1999 |
| DE | 100 18 757 A1 | 10/2001 |
| DE | 100 26 035 A1 | 12/2001 |
| EP | 0 379 759 B1 | 4/1995 |
| EP | 1 058 060 A1 | 12/2000 |

* cited by examiner

*Primary Examiner*—Kevin Lee

(57) ABSTRACT

Gas flow control is addressed using a controllable approach that facilitates safe operation. According to an example embodiment, a control arrangement for gas flow comprises two main valves connected in series and two servo valves operated by an actuator, the opening of the main valves being controlled via said servo valves. The main valves are operated by means of diaphragms limiting a first gas chamber, wherein the first servo valve is connected to the first gas chamber of the first main valve, to a second gas chamber in the inlet area of the first main valve and to the first gas chamber of the second main valve. Due to this construction a leakage gas flow out of the first gas chamber of the first main valve leads, if the first servo valve fails, to an increase in pressure in the first gas chamber of the second main valve, whereby it is ensured that the main valve is safely closed.

22 Claims, 5 Drawing Sheets

GAS FLOW CONTROL

FIELD OF THE INVENTION

The invention relates to gas flow control, and more particularly, to a dual-valve approach for controlling the flow of gas.

BACKGROUND

Many types of gas flow controllers have been implemented for a variety of applications. For example, a variety of known control arrangements for gas burners comprise a main valve, a servo valve and a servo controller, wherein the servo controller serves to control a gas output pressure by controlling the opening of the main valve. For the modulation of the gas output pressure an actuator is provided for the servo valve which makes the servo valve to open and close with a corresponding pulse width.

However, it is often that an increased safety standard is required in control arrangements for gas burners. Accordingly, an increased safety is required with respect to the closing of the main valve and an interruption of the flow of gas. Such safety standards are usually taken into account by a second main valve connected in series. In such a construction it is required that, even if one of the main valves is defective or fails, the flow of gas is safely interrupted. In most cases, however, such control arrangements permit little to no modulation of the pressure and the valve, respectively.

SUMMARY

The present invention is directed to a control arrangement for gas flow that addresses challenges including those discussed above.

According to an example embodiment of the present invention, a gas flow arrangement includes first and second main valves and a first servo valve configured and arranged for controlling the actuation of the first main valve. The first servo valve is further coupled via a gas line to the second main valve and adapted to flow gas from the first main valve to the second main valve when the first servo valve fails. For instance, when the first servo valve is controllable by an actuator and the actuator fails such that the first main valve is undesirably open, the first servo valve flows gas to cause the second main valve to close (or remain closed). With this approach, undesirable gas flow resulting from a failure in the servo valve controller is mitigated while allowing controllable modulation of the main valves.

BRIEF DESCRIPTION OF THE FIGURES

In the following, the invention will be described more precisely by referring to example embodiments in combination with the attached drawings wherein.

DETAILED DESCRIPTION

Figure 1:
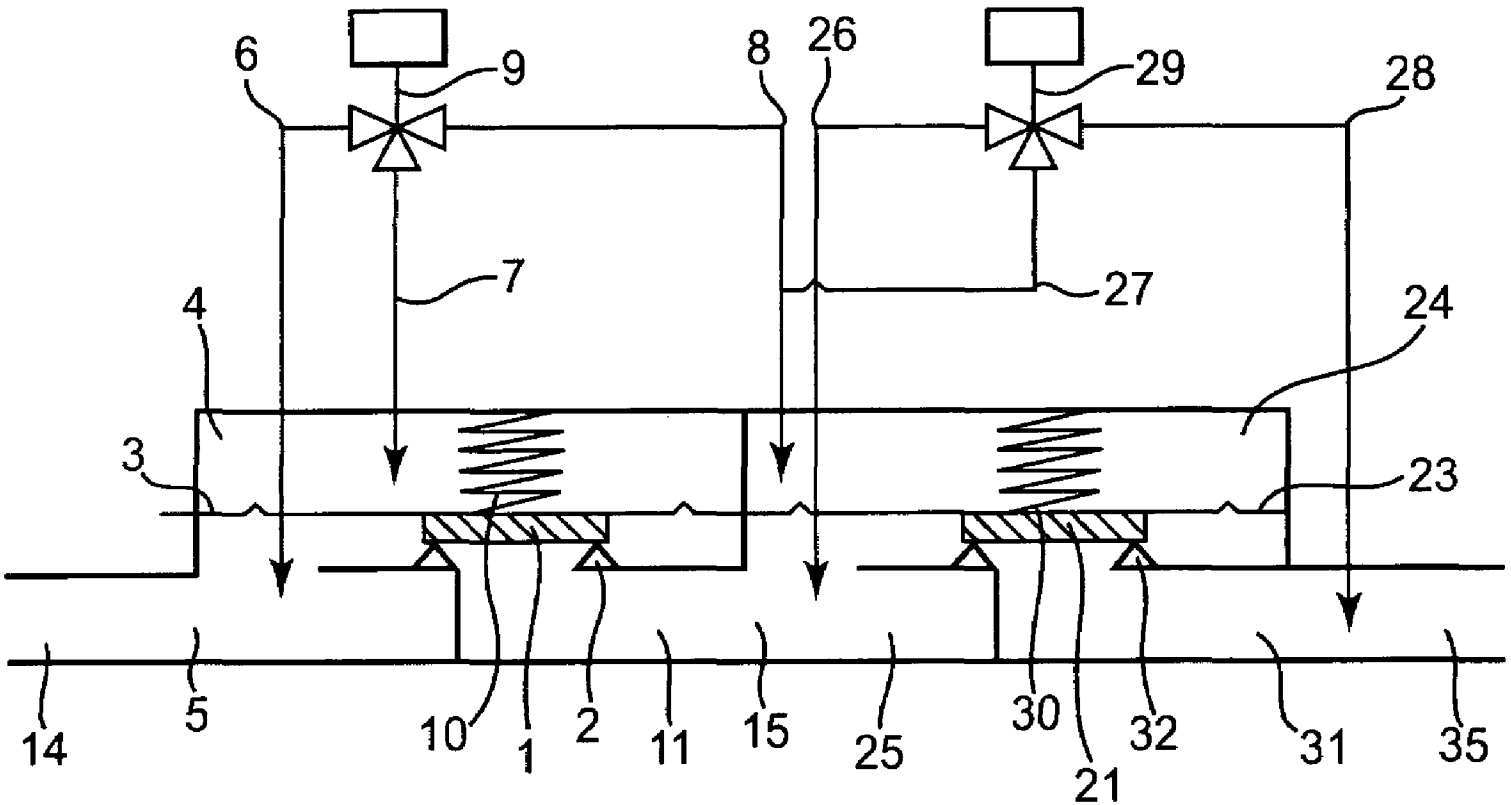
FIG. 1 shows an arrangement including two three-way valves, according to an example embodiment of the present invention.

In the following description, reference is made to the accompanying drawings that form a part hereof, and in which is shown by way of illustration particular embodiments in which the invention may be practiced. It is to be understood that other embodiments may be utilized, as structural and operational changes may be made without departing from the scope of the present invention.

According to an example embodiment of the invention, a control arrangement includes two main valves connected in series, each being controlled by a servo valve operated by an actuator. The main valves are operable by means of a diaphragm limiting a first gas chamber in each of the main valves. The diaphragm actuates a valve member in open and closed directions as a function of a differential pressure on opposing sides of the diaphragm, the first gas chamber being on one side and a second gas chamber being on the opposing side. A first servo valve is connected via gas lines to three elements: the first gas chamber of the first main valve, a second gas chamber in the inlet area of the first main valve and, via a third gas line, to the first gas chamber of the second main valve.

In case of a malfunction of the first servo valve and a relief/discharge of the first gas chamber resulting therefrom, which leads to the main valve being opened, the first servo valve discharges gas from the first gas chamber of the first main valve into the first gas chamber of the second main valve. The discharged gas creates a difference in pressure existing across the diaphragm in the second main valve that causes the second main valve to close. The gas discharge occurs selectively and, for example, when the first servo valve is de-energized or otherwise fails. Therefore, a malfunction of the first servo valve cannot result in the control arrangement being unintentionally opened and in gas unintentionally flowing through the control arrangement.

In one implementation, the first servo valve includes a three-way valve means that is switched such that either the first gas chamber is connected to the second gas chamber or the first gas chamber is connected to the third gas chamber. The three-way valve means may, for example, include a single three-way valve or a combination of two-way valves. The main valve can be easily controlled by means of such a circuit and, furthermore, the opening cross-section of the main valve can be modulated so as to achieve the desired modulation of the flow of gas through the control arrangement.

It is useful to load the main valve by means of a spring in the closed position and to open it by subpressure in the first gas chamber as against the second gas chamber. To this effect the main valve is operatively connected with a diaphragm separating the first gas chamber. The main valve is closed by overpressure in the first gas chamber and the force of the spring.

In various implementations, certain requirements are made on such generic control arrangements with respect to the opening and closing speed of the main valve. In order to fulfill these requirements, the cross-sections and resistance of flow in the gas lines and through the valves are selected to achieve desired opening and closing speeds of the main valve. In one instance, the cross-section and the resistance of flow in the gas lines and the valves, in particular in the gas line connecting the valves to the second gas chamber, and in the corresponding inlet area of the valves are selected for a modulation of the opening of the main valve. An effective and well-controllable modulation is only possible, if the desired opening cross-section of the main valve is reproducible and reliably adjustable. This approach is achieved, for example, by controlling the gas line to achieve a rise in pressure in the first gas chamber independently from the control of a gas line for achieving a drop in pressure in the first gas chamber.

The second servo valve can be implemented in a variety of manners, with the first servo valve serving the function of shutting off the second main valve. In one implementation, the second servo valve (e.g., a three-way valve means) is connected via a first gas line to the third gas line of the first servo valve and, in this way, to the first gas chamber of the second main valve. In an alternate implementation, the second servo valve is directly connected to the first gas chamber of the second main valve. The second servo valve is connected by a second gas line to a second gas chamber of the second main valve in the inlet area and furthermore by a third gas line to a third gas chamber in the outlet area of the control arrangement. In this way, the difference in pressure between the first and second gas chambers of the second main valve can be adjusted in the inlet area with the second servo valve so as to actuate the diaphragm and thereby operate the second main valve.

In one implementation, the second servo valve includes a two-way valve arrangement connected in a similar way to that discussed above for controlling the second main valve. A first two-way valve is connected by a gas line on the inlet side of the two-way valve to the gas line of the first servo valve. Optionally, the gas line on the inlet side is coupled to the first gas chamber of the second main valve in the instance where the outlet of the first servo valve is coupled to the first gas chamber of the second main valve (e.g., via the outlet of the first main valve). The outlet of the first two-way valve is coupled to the inlet of a second two-way valve, which are both coupled to the second gas chamber of the second main valve in the inlet area. Furthermore a third gas line is arranged connecting an outlet of the second two-way valve to a third gas chamber in the outlet area of the control arrangement. This third gas line discharges the gas out of the first gas chamber of the second main valve into the outlet area to thus open the second main valve via pressure on the diaphragm. An example approach to the functioning of this construction is described in greater detail below in connection with FIG. 5. When using two-way valves the inlet side of which is connected to two gas chambers, the cross-sections and/or resistance of flow of the gas lines are selectively adjusted, relative to each other, wherein throttles can be provided in the gas lines to influence the resistance of flow accordingly.

In another implementation, a pressure relief valve is located between the third gas line and the third gas chamber, i.e., the discharge line of the second servo valve. This pressure relief valve closes the third gas line of the second servo valve and thus the discharge line as from a certain limiting pressure in the outlet area of the control arrangement. This closing thus causes the second main valve to be closed first (prior to the first main valve) so as to protect the gas burner from overpressure.

In another implementation, the first servo valve includes a two-way valve arrangement having a first two-way valve connected on the inlet side by the first gas line to the first gas chamber of the first main valve and on the outlet side by the second gas line to the second gas chamber of the firs main valve. A second two-way valve is coupled on its inlet side to the outlet of the first two-way valve (and, thus, to the second gas chamber of the first main valve). An outlet from the second two-way valve is coupled to an outlet of the first main valve.

The cross-sections and/or resistance of flow of the gas lines from the first gas chamber to the first two-way valve and from the second gas chamber to the second two-way valve are optionally designed differently. In this way, it is also possible, such as in the described construction above with three-way valves, to ensure that the two main valves are safely closed. In order to adjust the resistance of flow of the different gas lines throttles are optionally provided in the gas lines. It is useful to provide such a construction with a pressure controller between the third gas line and the third gas chamber, by means of which it may be possible to first close the second main valve in dependence on the outlet pressure in the outlet area of the control arrangement. The functioning fundamentally corresponds to the described construction above being provided with a relief valve, wherein the limiting pressure is adjustable or changeable by the pressure controller.

FIG. 1 shows an arrangement including first and second main valves, according to another example embodiment of the present invention. The functioning of the first main valve is described as follows. The gas flows out of the inlet 14 to the second gas chamber 5. If the main valve is in the represented closed position, i.e., the valve disk 1 rests on the valve seat 2, the gas cannot continue flowing to the third gas chamber 11 and thus to the outlet 15. The flow of gas is interrupted and the control arrangement is blocked. The valve disk 1 is pressed by means of a pressure spring 10 into the closed position, i.e., onto the valve seat 2. The valve disk 1 is operatively connected to a diaphragm 3 separating a first gas chamber 4 in the upper area of the control arrangement. The main valve is closed, if there is an overpressure in the first gas chamber 4 as against the second gas chamber 5, wherein the force of the pressure spring 10 supports the closing process. The three-way valve 9 is connected to three gas lines, the first gas line 7 thereof being connected to the first gas chamber 4 above the diaphragm 3. The second gas line 6 connects the three-way valve 9 to the second gas chamber 5. The third gas line 8 finally connects the three-way valve 9 to the third gas chamber 11.

In the represented closed position the three-way valve 9 is switched such that the first gas line 7 and the second gas line 6 are connected to each other. Due to this switching the gas pressure existing at the inlet 14 and thus in the second gas chamber 5 is introduced into the first gas chamber 4. Thus there is not difference in pressure between the first gas chamber 4 and the second gas chamber 5. Due to the missing difference in pressure the diaphragm 3 does not act on the main valve and the valve disk 1 of the main valve is kept in the closed position by the spring 10.

In order to open the main valve the three-way valve 9 is brought into a position connecting the first gas line 7 to the third gas line 8. Due to this connection the pressure in the first gas chamber 4 is discharged to the third gas chamber 11 and thus to the outlet side of the first main valve. Therefore the pressure in the first gas chamber 4 is quickly reduced. Due to the thus arising difference in pressure between the first gas chamber 4 and the second gas chamber 5 the main valve is opened, since the pressure in the second gas chamber 5 is higher than the pressure in the first gas chamber 4. Thus the valve disk is moved upwards via the diaphragm 3 against the force of the spring 10 and lifted off the valve seat 2, whereby the opening cross-section of the main valve is released. If the main valve shall be closed again, the three-way valve 9 is just brought into the position mentioned at the beginning in which the first gas line 7 is connected to the second gas line 6. In this way, pressure is rebuilt in the first gas chamber 4 and the main valve is closed. By a suitable intermediate position of the three-way valve 9 it is possible to adjust a certain difference in pressure between the first gas chamber 4 and the second gas chamber 5. To this effect, the flowing-in of the gas into the first gas chamber 4 via the second gas line 6 and the first gas line 7 as well as the flowing-off of the gas via the third gas line 8 has to be adjusted accordingly.

The cross-sections of flow through the gas lines as well as through the three-way valve 4 are adjusted, just like the resistance of flow, to the opening and closing behavior of the main valve. In order to achieve a quick opening and/or closing large cross-sections and low resistance of flow are fundamentally useful. However, the adjustment of the cross-sections and resistance of flow has to be effected also with respect to the desired modulation behavior of the main valve. Therefore, especially the connection of the first gas chamber 4 to the second gas chamber 5 has to be adjusted, with respect to cross-section and resistance of flow, to the opening behavior of the main valve, in particular to the spring 10 as well as the diaphragm 3, so as to make the desired modulation of the opening cross-section possible.

In order to open the first main valve, the gas in the first gas chamber 4 is thus discharged into the first gas chamber 24 of the second main valve via the gas lines 7 and 8. If, furthermore, the second servo valve 29 is switched such that the first gas line 27 thereof is connected to the third gas line 28, the first gas chamber 24 of the second main valve is connected to the third gas chamber 31 of the second main valve. In this way, also the first gas chamber 24 of the second main valve is discharged into the third gas chamber 31 of the second main valve and, consequently, into the outlet 35 of the control arrangement. Thus both first gas chambers 4, 24 of the main valves are discharged and thus both main valves are opened. If the servo valves 9 and 29 are switched simultaneously, the gas directly flows out of the first gas chamber 4 of the first main valve into the third gas chamber 31 of the second main valve via the second servo valve 29. For closing the control arrangement the first servo valve 9 is brought into the position connecting the gas lines 6 and 7 to each other, and thus the first gas chamber 4 of the first main valve is connected to the second gas chamber 5 of the first main valve. In this way, the difference in pressure between the two gas chambers is removed and the first main valve is closed. Analogously, the second servo valve 29 is brought into the position connecting the first gas line 27 of the second main valve to the second gas line 26 of the second main valve so as to connect in the same way the first gas chamber 24 of the second main valve to the second gas chamber 25 of the second main valve. In this way, also the difference in pressure between the first gas chamber 24 and the second gas chamber 25 of the second main valve is removed and the second main valve is closed.

It is useful that a modulation is effected by means of the first servo valve 9 by bringing the second servo valve 29, as explained, by the connection of the gas lines 27 and 28 into the position in which the first gas chamber 24 of the second main valve is discharged and thus the second main valve is completely opened. A modulation can then be effected by appropriately adjusting the differential pressure between the first gas chamber 4 and the second gas chamber 5 of the first main valve by means of the first servo valve 9. In this position, gas flowing into the third gas line 8 is directly discharged via the second servo valve 29 into the third gas chamber 31 of the second main valve and thus into the outlet of the control arrangement without influencing the opening of the second main valve. A modulation can also be effected by a pulse width modulation of the first servo valve 9. For general information regarding gas valve control and for specific information regarding an example approach to pulse width modulation and gas valve control that may be implemented in connection with the present invention, reference may be made to German Patent No. DE 100 26 035 A1, which is fully incorporated herein by reference.

Due to the described construction it is ensured that, even if one of the servo valves 9 or 29 fails, no gas can flow from the gas inlet 14 to the gas outlet 35. No matter which of the servo valves fails, in any case the other servo valve is closed due the described construction and the flow of gas is interrupted. The mentioned difference in pressure between the gas chambers and the force of the spring, respectively, causes the valves to be closed. In this case, the closing is supported by the gas inlet pressure in the described manner. In an orderly operation of the control arrangement both servo valves 9, 29 are closed, when the flow of gas shall be interrupted. It does not matter which of the servo valves is closed first, since due to the described construction and the mode of operation the closing of one servo valve automatically results in the closing of the other servo valve.

A modulation of the control arrangement is possible in an easy way, since the servo valves are modulated between the inlet pressure and the outlet pressure and these pressures are determined so that the control arrangement can be modulated exactly in the desired way. In this case, it does not matter whether the first servo valve 9 or the second servo valve 29 is modulated. A modulation can also be effected, when the second servo valve 29 is in the completely opened position, since the modulation is then exclusively effected via the first servo valve 9. In the same way the first servo valve 9 can be in the completely opened position and a modulation can be effected via the second servo valve 29. It is self-evident that also both servo valves 9 and 29 can be modulated simultaneously.

Various elements in the following figures are similar to those shown and discussed above in connection with FIG. 1 (and other figures), with further discussion of certain elements thereof omitted for brevity.

Figure 2:
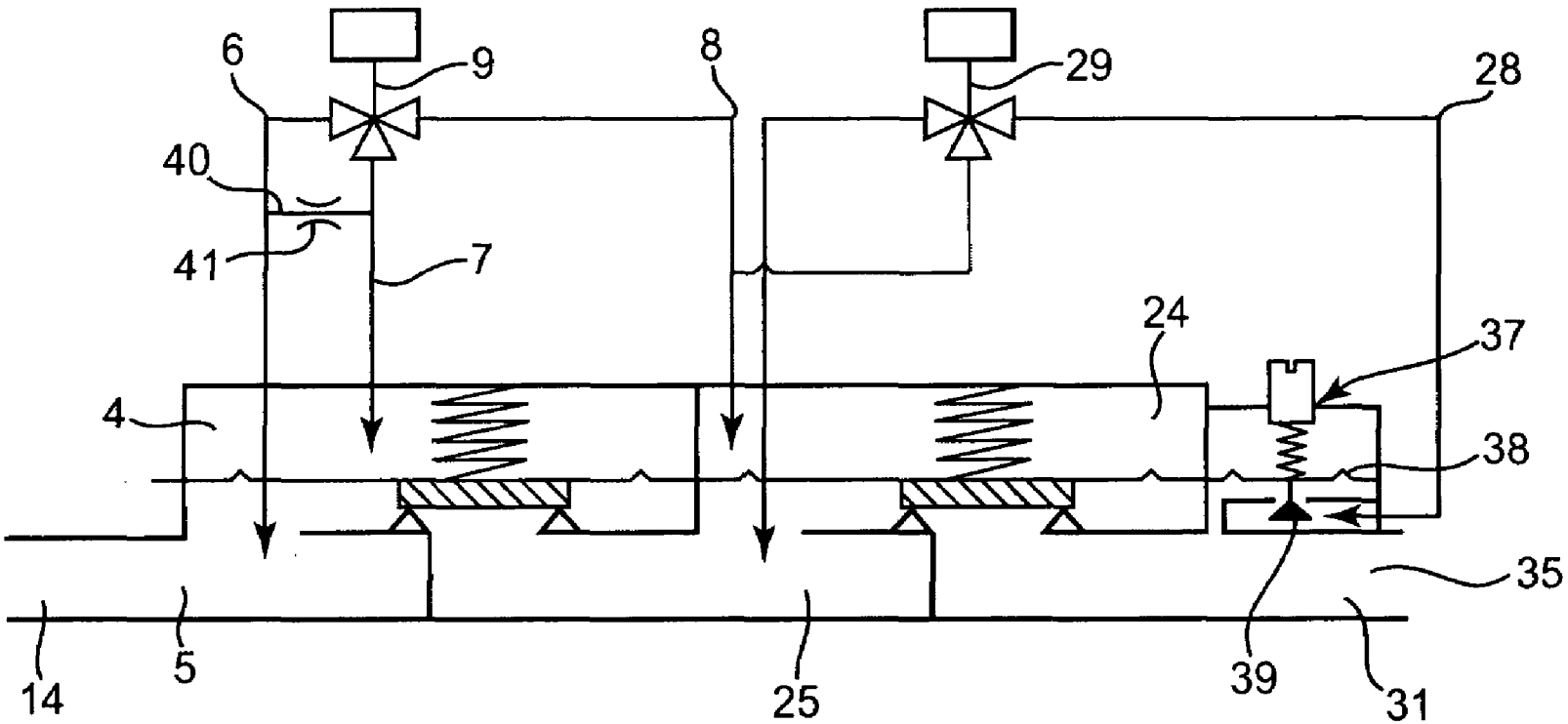
FIG. 2 shows with the arrangement similar to that shown in FIG. 1 and further including a pressure relief valve, according to another example embodiment of the present invention.

FIG. 2 shows another example embodiment of the present invention, similar to that shown and described above in connection with FIG. 1. A pressure relief valve 37 is provided between the third gas line 28 of the second main valve and the third gas chamber 31 of the second main valve, said pressure relief valve comprising, like the main valves, a diaphragm 38 operating the valve body 39 and moving same against a valve seat, if need be. In contrast to the main valves the valve body 39 of the pressure relief valve 37 is loaded by a spring in the open position and closed by the diaphragm 38, when a certain limiting pressure has been reached in the third gas chamber 31.

By this construction it is ensured that, if there is an overpressure in the third gas chamber 31 of the second main valve and thus in the outlet 35 of the control arrangement, the pressure relief valve closes the third gas line 28 and thus prevents, in case of an open control arrangement, pressure discharging out of the first gas chamber 24 of the second main valve into the third gas chamber 31 of the second main valve. Therefore, an overpressure closing the second main valve can be rebuilt in the first gas chamber 24 of the second main valve as against the second gas chamber 25 of the second main valve. To this effect, a flow of gas into the first gas chamber 24 of the second main valve is however necessary. In the open position of the control arrangement the gas line 7 is connected, as described, to the gas line 8 via the first servo valve so as to discharge the pressure out of the first gas chamber 4 of the first main valve. If this pressure is discharged, no gas flows out of the first gas chamber 4 of the first main valve into the first gas chamber 24 of the second main valve.

A connector 40 connects the first gas line 7 with the second gas line 6 of the first servo valve 9. This connection 40 has a relatively high resistance of flow that can be defined by a throttle 41. Thus always a low amount of gas flows through this connection 40 out of the second gas chamber 5 of the first main valve into the first gas line 7 and into the first gas chamber 4 of the first main valve, and in the mentioned position of the first servo valve 9 into the first gas chamber 24 of the second servo valve 29, respectively. If in the open position of the control arrangement there is a discharge through the third gas line 28 of the second servo valve 29, the flow of gas flowing via the connection 40 is discharged into the third gas chamber 31 of the second main valve and thus into the outlet of the control arrangement without influencing the position of the main valve. If the third gas line 28 is however closed by the pressure relief valve 37, the gas flows through the connection 40 and the first servo valve 9 into the third gas line 8 and through same into the first gas chamber 24 of the second main valve. Since a discharge is no longer effected, a pressure corresponding to the inlet pressure in the second gas chamber 5 of the first main valve and in the inlet area 14 of the control arrangement, respectively, builds up to an increasing degree in the first gas chamber 24. Since the pressure in the second gas chamber 25 of the second main valve also corresponds to the pressure in the inlet area 14 of the control arrangement, there is a pressure compensation between the first gas chamber 24 and, consequently, the second gas chamber 25 of the second main valve and thus the second main valve is closed.

Following the above paragraph, the pressure in the first gas chamber 4 of the first main valve will also increase, since the amount of gas flowing via the connection 40 is no longer discharged through the third gas line 8 of the first main valve, but flows via the first gas line 7 into the first gas chamber 4 of the first main valve. Therefrom it results that also the first main valve is closed. In this way, the desired feature of safety is obtained that, in case of overpressure in the outlet 35 of the control arrangement, the two main valves are completely closed.

Figure 3:
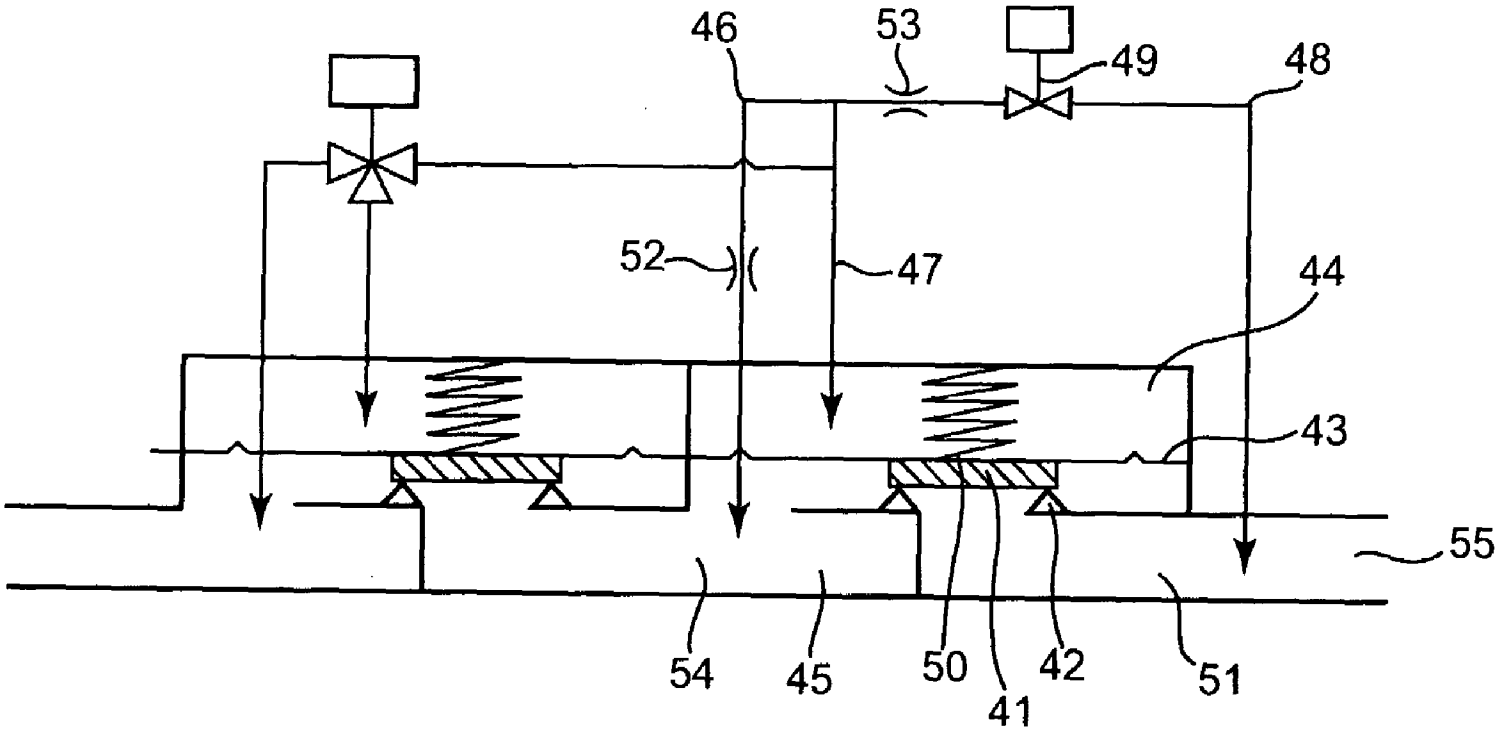
FIG. 3 shows an arrangement including a three-way valve together with a two-way valve, according to another example embodiment of the present invention.

FIG. 3 shows another example embodiment in which the second servo valve includes a two-way valve 49. This example embodiment may be implemented in connection with FIG. 1, with the second servo valve and the functioning thereof using this approach explained as follows.

The valve disk 41 is connected to a diaphragm 43 above which a first gas chamber 44 is provided. The gas flows out of the inlet 54 into the second gas chamber 45 and, when the main valve is open, can continue flowing into the third gas chamber and from there towards the outlet 55. When the main valve is closed, a flow of gas is interrupted. It is the closing position in which the two-way valve 49 (being, e.g., electrically operable) is in the closed position. Therefore gas flows into the first gas line 47 via the second gas line 46 having a certain resistance, which can be influenced by a throttle 52, if need be, since a flow of gas through the two-way valve 49 is not possible due to its closed position. For this reason there is a pressure compensation between the first gas chamber 44 and the second gas chamber 45. Due to this pressure compensation the main valve is safely kept in the closed position, since this valve is loaded by the pressure spring 50 in the closed position.

When the two-way valve 49 is opened, gas flows out of the first gas chamber 44 via the first gas line and out of the second gas chamber 45 via the second gas line 46, through the two-way valve 49 and into the third gas line 48 to the third gas chamber 51. The section of line in front of the two-way valve 49 and through the two-way valve 49, respectively, has a certain resistance of flow that can be influenced by a throttle 53, if need be. Since, as indicated by the marked throttles 52, 53, the resistance of flow of the second gas line 46 is larger than that of the first gas line 47, the gas flows off more quickly out of the first gas chamber 44. Furthermore no gas continues flowing into the first gas chamber via the first and second gas lines 47, 46, since this gas rather flows via the two-way valve 49 into the third gas line 48 and thus into the third gas chamber 51. The pressure in the first gas chamber 44 thus decreases and becomes lower than the pressure in the second gas chamber 45 defined by the inlet pressure. Due to the arising difference in pressure the main valve opens against the force of the pressure spring 50 and the gas can flow out of the second gas chamber 45 via the third gas chamber 51 towards the outlet 55. When the two-way valve 49 is closed again, i.e., when it is possible that gas flows into the third gas chamber 51 via the third gas line 48, there is again a pressure compensation between the first 44 and the second gas chamber 45, and the result of this is that the main valve closes again.

Just as discussed in connection with FIG. 1, gas is discharged, in case of a malfunction of the first servo valve, into the gas chamber 44 of the second main valve via the first gas line 47. Hereby the pressure increases in the first gas chamber 44, since the second servo valve 49 is closed in the closing position. In this way, the second main valve is kept safely closed, even if there is a malfunction of the first servo valve. A malfunction of the second servo valve 49, in which gas pressure is discharged out of the first gas chamber 44 into the third gas line 48—although the control arrangement shall be kept in the closed position—likewise results in the closing function of the first main valve not being impaired and thus the control arrangement being nevertheless kept safely closed.

Due to the described construction it is ensured that, even if one of the servo valves fails, no gas can flow out of the gas inlet to the gas outlet 55. No matter which of the servo valves fails, in any case the other servo valve is closed due the described construction and the flow of gas is interrupted. The closing of the valves is caused by the mentioned difference in pressure between the gas chambers and the force of the spring, respectively. In this case, the closing is supported by the gas inlet pressure in the described manner. In an orderly operation of the control arrangement both servo valves are closed, when the flow of gas shall be interrupted. It does not matter which of the servo valves is closed first, since due to the described construction and mode of operation the closing of one servo valve automatically results in the closing of the other servo valve.

A modulation of the control arrangement is possible in an easy way, since the servo valves are modulated between the inlet pressure and the outlet pressure and these pressures are determined so that the control arrangement can be modulated exactly in the desired way. In this case, it does not matter whether the first servo valve 9 or the second servo valve 49 is modulated. A modulation can also be effected, when the second servo valve 49 is in the completely opened position, since the modulation is then exclusively effected via the first servo valve. In the same way the first servo valve can be in the completely opened position and a modulation can be effected via the second servo valve 49. It is self-evident that also both servo valves can be modulated simultaneously.

Figure 4:
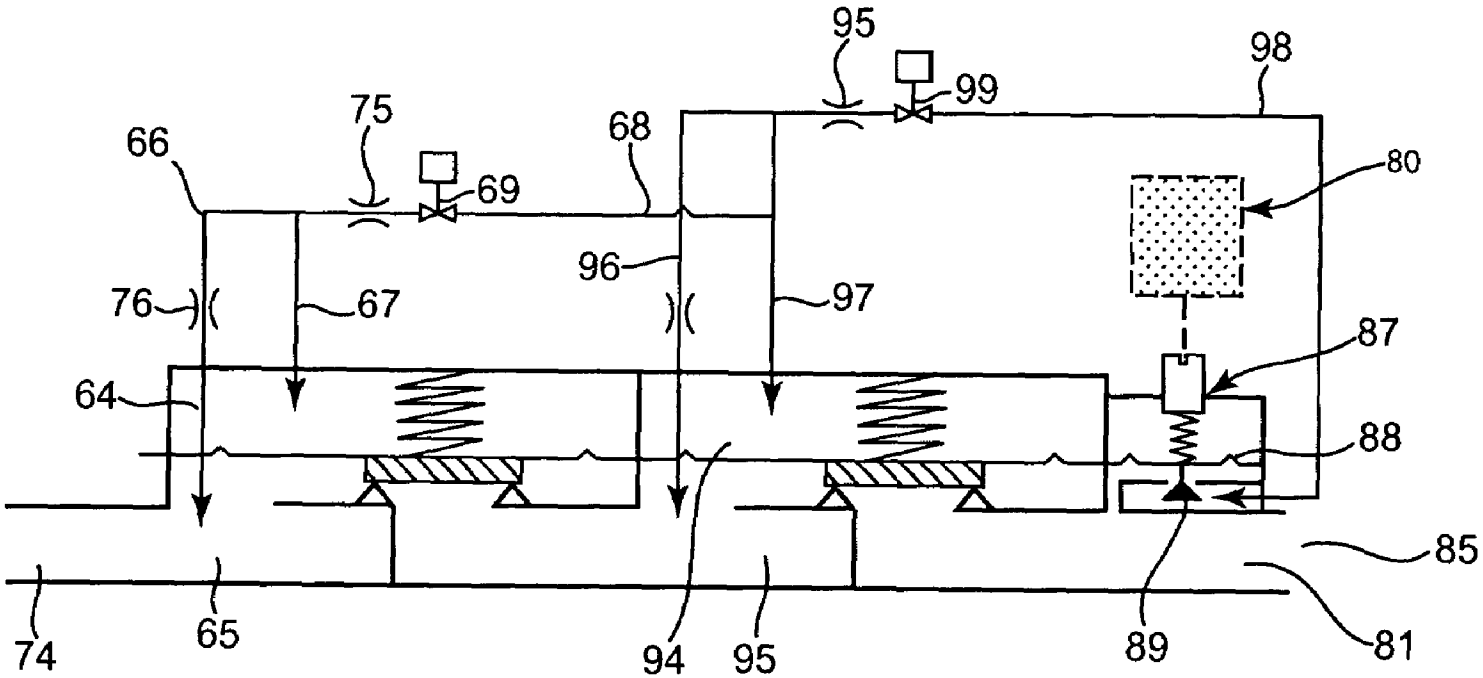
FIG. 4 an arrangement in which two two-way valves are provided, according to another example embodiment of the present invention.

FIG. 4 shows another example embodiment of the present invention, similar to that shown and discussed in connection with FIG. 3 except the first servo valve 69 being a two-way valve. Furthermore, like in the embodiment according to FIG. 2, a pressure controller 90 is provided basically corresponding to the pressure relief valve 37 from its functioning, wherein the limiting pressure is however adjustable by an actuator 90 in operation of the control arrangement so that the output pressure can be controlled by means of this pressure controller 90. The functioning of the two-way valve along with the appertaining pressure lines and throttles was explained in conjunction with the second servo valve of the embodiment according to FIG. 3. Therefore the functioning of certain similar elements, e.g., the two-way valve 69, the second two-way valve 99, the pressure controller 87, and a valve body 89 being loaded by a spring in the open position that can be brought into the closed position by means of a diaphragm 88.

When the control arrangement is in the closed position and, due to a defect of the first servo valve 69, there is nevertheless a pressure discharge out of the first gas chamber 64 of the first main valve into the third gas line 68 via the first gas line 67, this gas is discharged—as in the above-described embodiments—into the first gas chamber 94 of the second main valve. In this way, it is ensured that the second main valve is safely closed, even if there is a defect of the first servo valve 69. If there is a defect of the second servo valve 99 and a pressure discharge out of the first gas chamber 94 of the second main valve, the first main valve is not affected hereby—as explained in the embodiment according to FIG. 3—and this valve remains safely closed.

For opening the control arrangement the first servo valve 69 and the second servo valve 99 are opened. Gas flows out of the first gas chamber 64 of the first main valve via the first gas line 67, the throttle 75 and the third gas line 68 to the second servo valve 99. The gas then flows via the second servo valve into the third gas line 98 out of the second servo valve 99 leading into the third gas chamber 81 of the second main valve via the pressure controller 87. When the second servo valve is opened, the gas likewise flows out of the first gas chamber 94 of the second main valve into the third gas line 98 via the first gas line 97 of the second main valve and the throttle 93. Thus the pressure decreases in the first gas chamber 64 of the first main valve and in the first gas chamber 94 of the second main valve. Due to the drop in pressure both main valves are opened.

For closing the control arrangement the servo valves 69 and 99 are closed so that gas pressure builds up in the first gas chamber 64 and 94 of the two main valves via the second gas line 66 and 96 as well as via the first gas line 67 and 97, wherein this gas pressure finally corresponds to the gas input pressure in the second gas chamber 65 and 95. As soon as the pressure compensation has been reached, both main valves close by the force of the springs.

Figure 5:
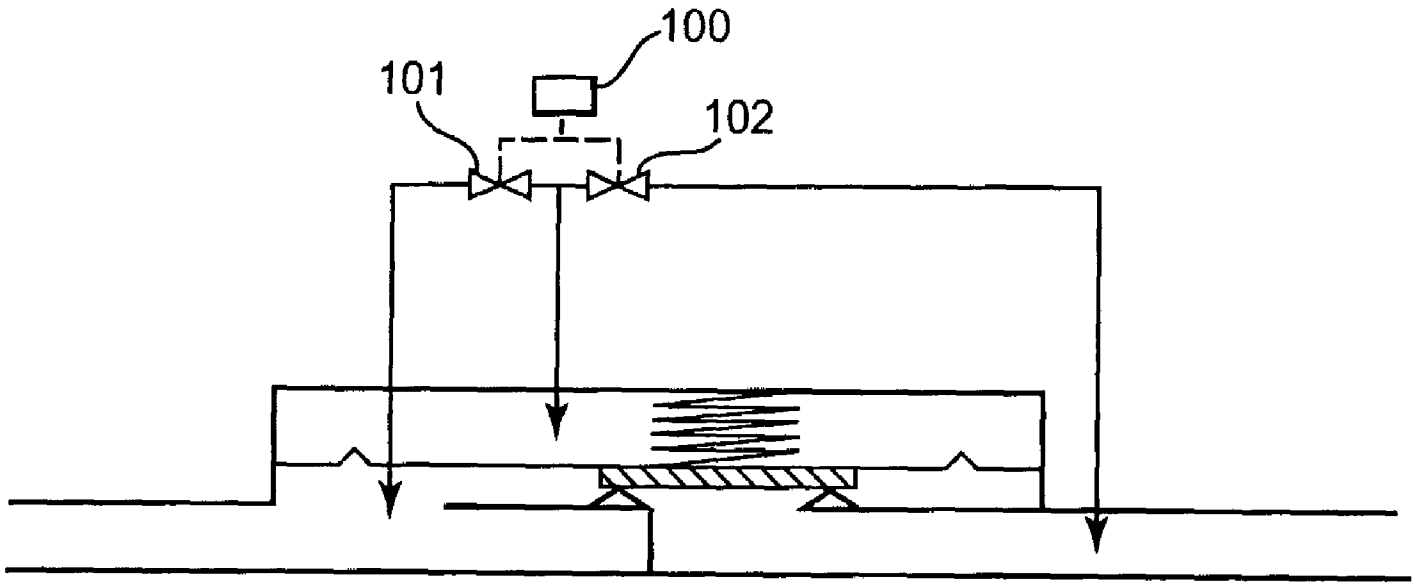
FIG. 5 shows a main valve arrangement that may be implemented, for example, with one or more of the example embodiments discussed herein.

FIG. 5 shows another example embodiment involving a main valve that may be implemented, for example, in connection with the embodiments shown and discussed in connection with FIGS. 1 to 3. In FIG. 5 only one main valve is shown with the second main valve omitted for brevity. The main valve shown in FIG. 5 can replace one or more of the main valves represented in the described embodiments herein. In the case of the main valve shown in FIG. 5 the three-way servo valve represented in the embodiments according to FIGS. 1 to 3 is replaced by two two-way valves. To this effect, a first two-way valve 101 and a second two-way valve 102 are provided. The valves are arranged as shown, wherein the first two-way valve 101 is disposed between the first and the second gas line and the second two-way valve 102 is disposed between the first gas line and the third gas line. The servo valves are operated by an actuator 100.

Gas flow is controlled with the two-way valve arrangement shown in FIG. 3 in a manner similar to that discussed in connection with the three-way valve 9 in FIG. 1. For example, when valve 101 is open and valve 102 is closed, lines 6 and 7 are coupled. When valve 101 is closed and valve 102 is opened, lines 7 and 8 are coupled. When both valves 101 and 102 are open, lines 6, 7 and 8 are all coupled.

The foregoing description of various embodiments of the invention has been presented for the purposes of illustration and description. It is not intended to be exhaustive or to limit the invention to the precise form disclosed. Many modifications and variations are possible in light of the above teaching. It is intended that the scope of the invention not be limited with this detailed description.

What is claimed is:

1. A gas flow controller comprising:

first and second main valves connected in series and first and second servo valves operated by an actuator, the opening of the first and second main valves being respectively controlled via said first and second servo valves, each of the main valves being operable by means of a diaphragm limiting a first gas chamber for each main valve; and said first servo valve being connected to said first gas chamber of the first main valve via a first gas line, to a second gas chamber in the inlet area of said first main valve via a second gas line and to said first gas chamber of the second main valve via a third gas line.

2. A gas flow controller according to claim 1, wherein the first servo valve is configured and arranged to modulate at least one of the first and second main valves using the pressure in the inlet area of the first main valve and the pressure in the outlet area of the second main valve as limiting pressures.

3. A gas flow controller according to claim 2, wherein at least one of said first servo valve and said second servo valve includes a three-way valve means and selectively connects said first gas chamber to said second gas chamber and to said outlet area of the second main valve.

4. A gas flow controller according to claim 3, characterized in that said three-way valve means includes at least one of: a three-way valve and a combination of two-way valves.

5. A gas flow controller according to claim 1, further comprising:

a spring configured and arranged to load the main valve in the closed position.

6. A gas flow controller according to claim 1, wherein the main valves are configured and arranged to respectively open in response to a sub-pressure in said first gas chamber for each valve relative to said second gas chamber for each valve.

7. A gas flow controller according to claim 1, further comprising:

for at least one of said main valves, a diaphragm connected to said at least one main valve and configured and arranged to substantially close said first gas chamber for said at least one main valve.

8. A gas flow controller according to claim 1, wherein the cross-sectional resistance and resistance of flow in the gas lines and through said servo valves are configured and arranged to control at least one of: the opening and closing speed of at least one of the main valves.

9. A gas flow controller according to claim 1, wherein the cross-sectional resistance and resistance of flow in the gas lines and through said servo valves are adjustable for modulating the opening/aperture cross-section of the main valves.

10. A gas flow controller according to claim 9, wherein the cross-sectional and flow resistance of the gas lines connecting at least one of the servo valves to the second gas chamber for at least one of the main valves and the corresponding inlet area of the at least one servo valve are adjustable for modulating the opening cross-section of the at least one main valve.

11. A gas flow controller according to claim 1, wherein said second servo valve includes a three-way valve means connected to at least one of said third gas line of said first servo valve and said first gas chamber of the second main valve, the three-way valve means further being connected to a second gas chamber of the second main valve in the inlet area and to a third gas chamber of the second main valve in the outlet area of the gas flow controller.

12. A gas flow controller according claim 1, wherein said second servo valve includes a two-way valve connected to at least one of the third gas line of said first servo valve and said first gas chamber of the second main valve via a gas line on an inlet side of the two-way valve and is connected to a second gas chamber of the second main valve on an outlet side of the two-way valve, further comprising:

an outlet gas line connecting the second servo valve to a third gas chamber of the second main valve in the outlet area of the gas flow controller, wherein at least one of the cross-sections and resistance of flow of the gas lines from said first gas chamber of the second main valve to said two-way valve and from said second gas chamber of the second main valve to said two-way valve are designed differently.

13. A gas flow controller according to claim 12, further comprising:

at least one throttle in a gas line coupled to the second servo valve.

14. A gas flow controller according to claim 12, further comprising:

a pressure relief valve between the outlet gas line of said second servo valve and said third gas chamber.

15. A gas flow controller according to claim 12, further comprising:

a pressure controller between the outlet gas line and said third gas chamber.

16. A gas flow controller according to claim 1, wherein the first servo valve includes a two-way valve connected on its inlet side to at least one of the first and second gas lines, wherein the cross-sections and/or resistance of flow of the gas lines from said first gas chamber to said two-way valve and from said second gas chamber to said two-way valve are designed differently.

17. A gas flow controller according to claim 16, further comprising:

at least one throttle in at least one of said first and second gas lines.

18. A gas flow controller according to claim 1, further comprising a gas line connection between the first and second gas lines of said first servo valve.

19. The gas flow controller of claim 18, wherein said gas line connection exhibits a higher resistance to gas flow, relative to the resistance in at least one of the first and second gas lines.

20. For use in a gas system including first and second main valves operable as a function of movement of a diaphragm responsive to gas pressure, a gas flow controller comprising:

a first servo valve coupled control a differential pressure across a diaphragm in the first main valve for controlling the actuation of the first main valve, the first servo valve further being coupled to the second main valve to selectively flow gas from the first main valve to the second main valve to close the second main valve.

21. The gas flow controller of claim 20, wherein each of the first and second main valves include inlet, outlet and auxiliary chambers, the inlet and outlet chambers of each main valve being separated by a valve member, the inlet and auxiliary chambers of each main valve being separated by a diaphragm coupled to the valve member of the respective main valve, the outlet chamber of the first main valve being coupled to the inlet chamber of the second main valve, and, for each main valve, the diaphragm being adapted to actuate the valve member in response to a differential gas pressure between the inlet and auxiliary chambers, wherein the first servo valve is adapted to flow gas to the auxiliary chamber of the second main valve to close the second main valve.

22. For use in a gas system including first and second main valves, a gas flow controller comprising:

a first servo valve arrangement coupled to a first gas chamber of the first main valve, to a second gas chamber at an inlet of the first main valve and to the second main valve, the first main valve being controllable in response to the first servo valve being actuated, the first servo valve arrangement adapted to flow gas from the first gas chamber to the second main valve to close the second main valve in response to the first servo valve arrangement failing.

* * * * *